US006109438A

United States Patent [19]

Sutherland

[11] Patent Number: 6,109,438

[45] Date of Patent: Aug. 29, 2000

[54] WRAP-AROUND ARTICLE CARRIER

[75] Inventor: Robert L. Sutherland, Kennesaw, Ga.

[73] Assignee: Riverwood International Corporation, Atlanta, Ga.

[21] Appl. No.: 09/243,992

[22] Filed: Feb. 3, 1999

[51] Int. Cl.[7] ..... B65D 65/00

[52] U.S. Cl. ..... 206/427; 206/196; 229/103.2; 229/143

[58] Field of Search ..... 206/427, 429, 206/433, 434, 435, 167, 170, 196; 229/103.2, 143

[56] References Cited

U.S. PATENT DOCUMENTS

| | | | |
|---|---|---|---|
| 4,164,286 | 8/1979 | Sutherland | 206/434 |
| 4,482,090 | 11/1984 | Milliens | 206/427 |
| 5,002,186 | 3/1991 | Cooper | 206/427 |
| 5,221,042 | 6/1993 | Oliff | 206/427 |
| 5,246,112 | 9/1993 | Stout et al. | 206/427 |
| 5,360,113 | 11/1994 | Harris | 206/427 |
| 5,704,470 | 1/1998 | Sutherland | 206/427 |

*Primary Examiner*—Paul T. Sewell
*Assistant Examiner*—Luan K. Bui

[57] ABSTRACT

A wrap-around article carrier, comprising a bottom panel having opposing side edges and further having opposing end edges, a first side panel and an opposing second side panel, and a top panel having opposing side edges. Each one of the side panels has a top edge and an opposing bottom edge that is connected to one of the side edges of the bottom panel. The side edges of the top panel are connected to one of the top edges of the side panels. The carrier further has a first end panel and an opposing second end panel. Each of the end panels has a bottom edge that is connected to one of the end edges of the bottom panel. The carrier further has an article holder connected to the top panel. The article holder contacts and secures the top of articles contained within the carrier.

11 Claims, 2 Drawing Sheets

WRAP-AROUND ARTICLE CARRIER

BACKGROUND OF THE INVENTION

1. Field of the Invention

The present invention relates, generally, to article carriers. More particularly, the invention relates to wrap-around article carriers formed by wrapping a flat carrier blank around a product configuration.

2. Background Information

Wrap-around article carriers are commonly used to package beverage cans and other articles. Basically, wrap-around article carriers are formed by grouping articles in an arrangement they are desired to be in after packaging to form a product configuration, and then wrapping a flat carrier blank around the product configuration. The blank is tightly drawn about the articles and the ends of the blank are connected to each other. Cutouts are often provided at the upper and lower portion of the side panels in order to grip the end portions of articles protruding through the cutouts. The cutouts allow the blank to be tightly wrapped around and to securely hold the product group. Wrap-around article carriers are economical to make and use because they typically use a smaller amount of paperboard than other cartons, and because they are stored and transported as a flat carrier blank rather than as a carton sleeve. Furthermore, wrap-around article carriers are sturdy and are well-accepted by the public.

The state of the art is believed to have limitations and shortcomings. Wraparound article carriers by their nature have been limited as to the number of articles they can hold before articles will spill out of the open ends of the article carrier. Normally, articles are arranged in two adjacent rows allowing the sides of the carrier to engage the outer portions of all of the articles in the carrier while the inner portions of the articles abut against each other. The end portions of the articles extend through the cutouts in the side panel, which prevent the articles from spilling through the open ends of the carrier. If three rows of articles were to be packaged in one of these wraparound article carriers, the articles in the middle row would not be in contact with the carrier, but would be held in place only by the pressure exerted by adjacent articles in the adjacent outer rows. Therefore, attempting to package a three-row product group using a typical known wrap-around article carriers increases the risk of the articles spilling out through the open ends of the carrier. Because this type of wrap-around article carriers normally can accommodate only two rows of articles, the number of articles that can be packaged is governed to a large extent by the desirable length of the package. Packages containing six articles are the most common, although packages containing eight articles can also be conveniently handled. Depending on the size of the articles, packages containing more than eight articles are not convenient to handle.

U.S. Pat. No. 5,611,431, assigned to Applicant's assignee, shows a wraparound article carrier for packaging three rows of articles. The '431 carrier is capable of conveniently packaging large numbers of articles, including product configurations of up to twenty-four. A separate reinforcement strip having clip-type support panels is glued to the underside of the top panel of the carrier. These support panels support the articles of the middle row and prevent the end articles from spilling through the open ends of the carrier. The reinforcement strip also helps form a two-ply handle for the carrier.

Applicant's invention provides a wrap-around article carrier which is believed to constitute an improvement over the known art.

BRIEF SUMMARY OF THE INVENTION

The present invention provides a wrap-around article carrier which generally comprises opposing side panels foldably connected to both a bottom panel and a top panel. Opposing end panels are likewise foldably connected to the bottom panel and the top panel, and are further attached to the side panels via gussets. The height of the opposing end panels is preferably less than the height of the side panels. The side panels have a top margin or bevel panel section formed by a score line, and further have cutouts in the side panels to help secure the articles in the carrier. The top panel of the carrier is formed from a glue or first top panel and a second top panel that overlaps and is attached to the first top panel. The end panels and the cutouts work together to hold the articles within the carrier and allow the carrier to hold larger product configurations.

The wrap-around article carrier of the present invention includes the incorporation of top and bottom end panels for securing articles within the carrier. The end panels are attached to the side panels via gussets to simplify the construction of the carrier. Glue is applied only upon the final closing the top panels. The blank used to form the article carrier is economically made because it is well-suited for a single knife layout.

The features, benefits and objects of this invention will become clear to those skilled in the art by reference to the following description, claims and drawings.

DETAILED DESCRIPTION

Figure 1:
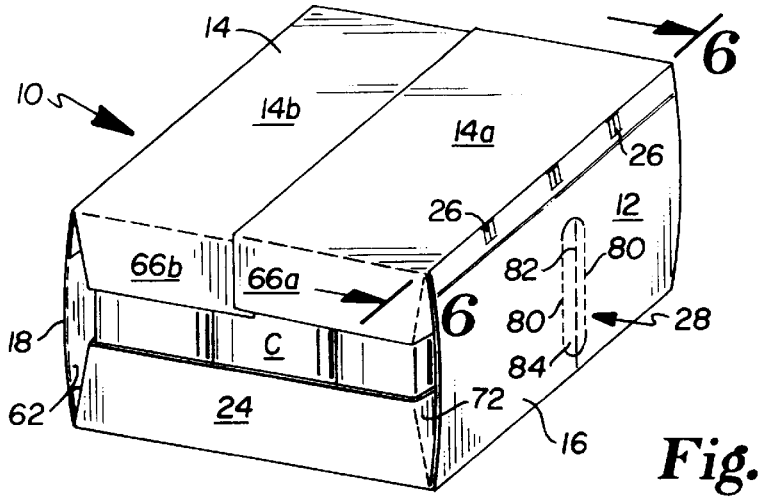
FIG. 1 is a perspective view of an embodiment of a wrap-around article carrier of the present invention.

Referring to FIG. 1, a package 10 is comprised of a wrap-around article carrier 12 and twelve beverage cans C contained within the carrier. The twelve cans form a product configuration of three adjacent rows by four adjacent columns. The carrier 12 includes a top panel 14 connected to side panels 16 and 18, which in turn are connected to a bottom panel 20, shown in FIGS. 3–5. The carrier 12 further includes end panels 22 and 24 that are connected to the bottom panel 20 and to the side panels 16 and 18 by gussets 70*a* and 70*c*, and end panels 66*a* and 66*b* that are connected to the top panels 14*a* and 14*b* by gussets 70*b* and 70*d*. Cutouts 26 in the upper portion of the side panels 16 and 18 are located between adjacent columns of the cans.

Figure 2:
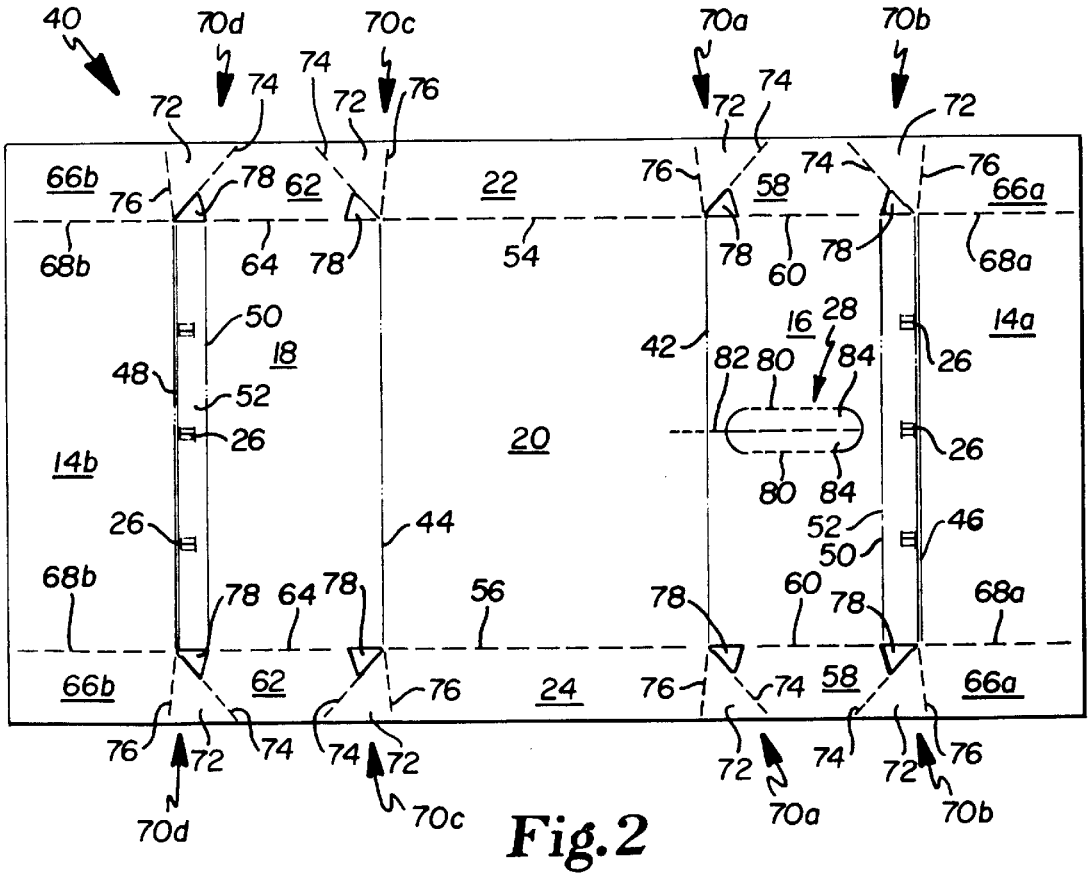
FIG. 2 is a plan view of a blank for forming the main wrap-around portion of the carrier of FIG. 1.

Referring to FIG. 2, a primary blank 40 for forming the wrap-around article carrier 12 shown in FIG. 1 is a generally rectangular sheet of paperboard or other material having sufficient strength and flexibility to be folded into place and function as a carrier 12. Bottom panel section 20 is connected by fold line 42 to side panel section 16 and by fold line 44 to side panel section 18. The side panel section 16 is connected to a top panel flap 14*a* by fold line 46, and the side panel section 18 is connected to a top panel flap 14*b* by fold line 48. The top panel flap 14*a* overlaps and is glued to the top panel flap 14*b* to form the top panel 14 shown in FIG. 1. Fold lines 50 are spaced a short distance from fold lines 46 and 48 to form bevel panel sections or top margins 52. The cutouts 26 are formed within the margins 52. The cutouts 26 are preferably formed by an I-shaped cut to form two tabs that fold about vertical lines into the carrier 12 and away from each other. The cutouts 26 on each side panel are spaced at intervals along the margins 52 that allow the tabs to extend between adjacent columns of cans C and help secure the cans within the carrier. The cans do not extend through the cutouts. The top margins 52 allow the side panels 16 and 18 to conform to the shape of the top of the cans, particularly when the carrier 12 is undergoing lifting stresses.

The bottom panel section 20 is connected to a bottom end panel flap 22 by fold line 54 and to an end panel flap 24 by fold line 56. The side panel section 16 is connected to a pair of first web flaps 58 by fold lines 60, and the side panel section 18 is connected to a pair of second web flaps 62 by fold lines 64. The top panel flap 14*a* is connected to a pair of top end panel flaps 66*a* by fold lines 68*a*, and the top panel flap 14*b* is connected to a pair of top end panel flaps 66*b* by fold lines 68*b*. The side panel section 16 is foldably connected to the bottom panel section 20 by first gussets 70*a* and to the top panel flap 14*a* by second gussets 70*b*. The side panel section 18 is foldably connected the bottom panel section 20 by second gussets 70*c* and to the top panel flap 14*b* by second gussets 70*d*. The gussets are formed by the side flaps 58 and 62 and the corner web panels 72. The web panels 72 are preferably triangular in shape, and are connected to the side flaps 58 and 60 by fold lines 74 and are connected to the end panels 22, 24, 66*a*, and 66*b* by fold lines 76. To assist with the folding of the blank 40 to form the carrier 12, it is preferred that the fold lines 74 be oriented at approximately a forty-five degree angle with respect to the fold lines 60 and 64. Furthermore, it is preferred that fold line 76 be slightly offset from normal with respect to the fold lines 64 and 68*b* to form a slightly acute angle between the fold lines 76 and the fold lines 54, 56 68*a* and 68*b*. Additionally, it is preferred that triangular openings 78 are formed where the flaps or panels 16, 58 and 72 and the flaps or panels 18, 62 and 72 are adjoined.

A handle 28 is formed by creating an opening in the side panel section 16. The handle 28 is defined by a perforated or scored edge 80 and a slit 82 that dissects the area defined by the scored edge 80 and that forms two tabs 84. The slit 82 extends a short distance into the bottom panel section 20 to help distribute the stresses that occur when the package 10 is lifted by the handle 28.

Figure 3:
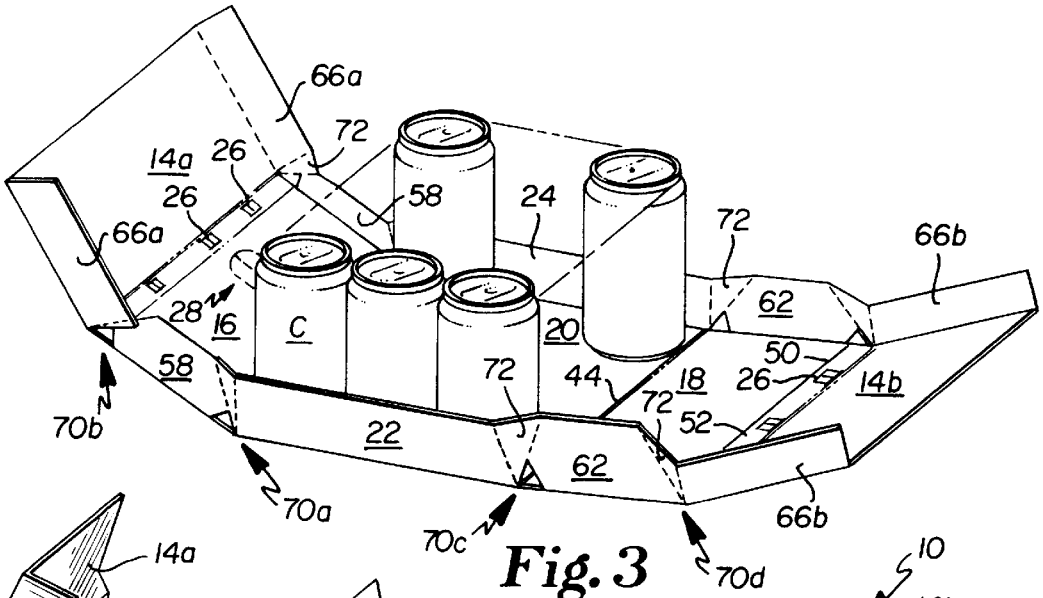
FIG. 3 is a perspective view illustrating the bottom end panels of the blank of FIG. 2 being folded up around an article group.
Figure 4:
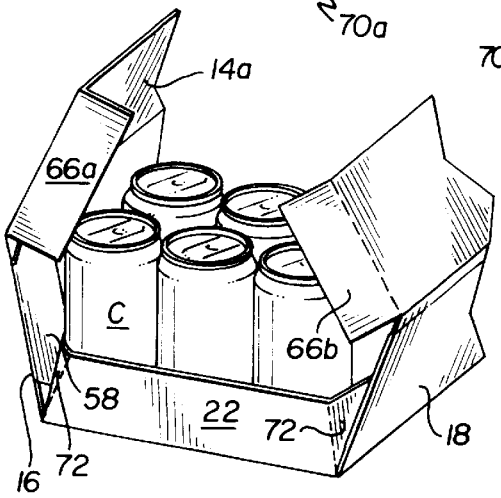
FIG. 4 is a partial perspective view illustrating the side panels and the top panels of the blank of FIG. 2 being folded around an article group.
Figure 5:
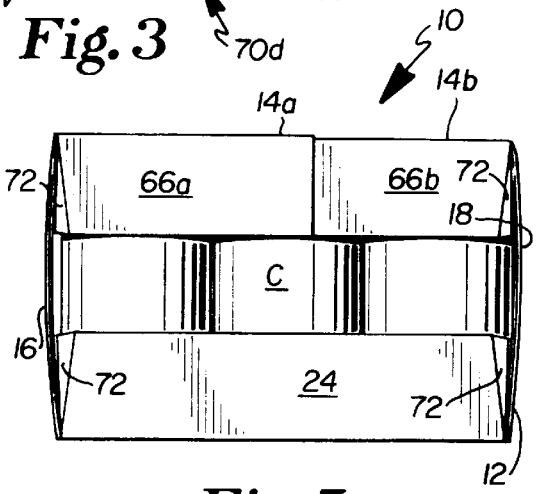
FIG. 5 is an end view of the wrap-around article carrier of FIG. 1.
Figure 6:
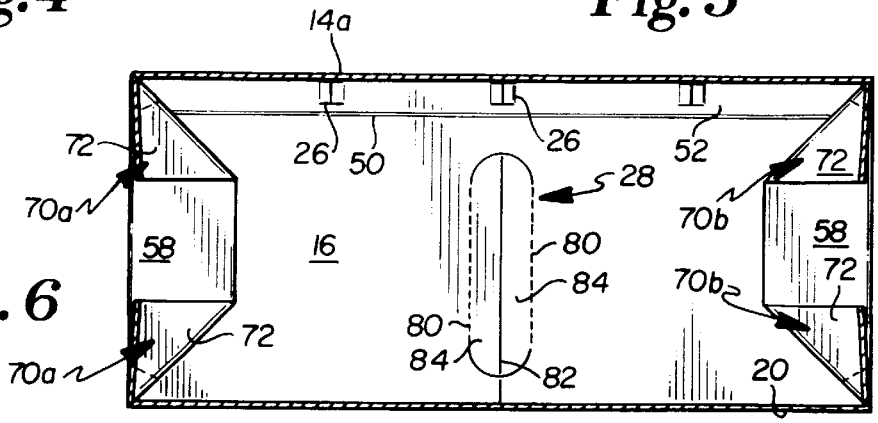
FIG. 6 is a cross-sectional view along line 6—6 of the wrap-around article carrier of FIG. 1.

To form a package 10 from the blank 40, twelve beverage cans are arranged into a product configuration comprising three rows and four columns as illustrated in FIG. 3, and are positioned on the bottom panel section 20. The blank 40 is schematically shown in FIG. 3 as being positioned in a partially folded condition, wherein the bottom end panels 22 and 24 have been folded upward and the side panels 16 and 18 are beginning to be folded upward. As illustrated in FIG. 4, the side panels 16 and 18 continue to be folded as the first and second top end panels 66*a* and 66*b* and the top panels 14*a* and 14*b* are clipped and the side flaps 58 and 62 are folded against their respective side panel 16 and 18. The top panel 14*b* is folded over the article group of cans C. Glue is applied to the stippled area shown in FIG. 4, and the top panel 14*a* is folded over and glued onto the top panel 14*b* to form the carrier 12 as illustrated in FIGS. 1 and 5, and the cross-sectional view of FIG. 6. As illustrated in FIG. 3–5, the side flaps 58 and 62 and the webs 72 are sandwiched between the side panels 16 and 18 and the article group of cans C. The gussets 70*a*–70*d* formed by the side flaps 58 and 62 and webs 72 provide a simplified means for constructing a wrap-around carrier with strong end panels that prevent the articles from spilling through open ends. Glue is applied only upon the final closing of the top panels 14*a* and 14*b*.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim, if any, is expressed as a means or step for performing a specified function it is intended that such claim be construed to cover the corresponding structure, material, or acts described in the specification and equivalents thereof, including both structural equivalents and equivalent structures, material-based equivalents and equivalent materials, and act-based equivalents and equivalent acts.

What is claimed is:

1. A wrap-around article carrier for containing a product formation defined by adjacent rows and adjacent columns of articles, comprising:

(a) a bottom panel having opposing side edges and opposing end edges;

(b) a first side panel and an opposing second side panel, each of said side panels having a top edge and an opposing bottom edge and further having opposing end edges, said bottom edge of each of said side panels being connected to one of said side edges of said bottom panel, said side panels having at least one cutout, said at least one cutout having opposing tabs, said at least one cutout being aligned between adjacent columns of articles;

(c) a top panel, said top panel including a first top panel and a second top panel, said first top panel having a side edge attached to said top edge of said first side panel, said second top panel having a side edge attached to said top edge of said second side panel, said first top panel being overlapped and attached to said second top panel, each of said first and second top panels further having opposing end edges;

(d) a pair of bottom end panels, each of said bottom end panels having a bottom edge, said bottom edge of each of said bottom end panels being connected to one of said end edges of said bottom panel;

(e) a pair of first top end panels and a pair of second top end panels, each of said first top end panels having a top edge connected to one of said end edges of said first top panel, each of said second top end panels having a top edge connected to one of said end edges of said second top panel; and (f) four first gussets and four second gussets foldably connected to each of said end panels, said first gussets being foldably connected to said first side panel, said second gussets being foldably connected to said second side panel.

2. The carrier of claim 1, wherein said first side panel further has a handle opening.

3. The carrier of claim 2, wherein said handle opening is defined by a scored edge and a slit that dissects an area defined by said scored edge, said slit and said scored edge defining a pair of tabs that fold into said carrier.

4. The carrier of claim 1, wherein said carrier contains a product formation defined by adjacent rows and adjacent columns of articles, said side panels having at least one cutout, said at least one cutout having opposing tabs, said at least one cutout being aligned between adjacent columns of articles.

5. The carrier of claim 4, wherein said at least one cutout is positioned within a top margin of each of said side panels.

6. The carrier of claim 5, wherein said top margin of each of said side panels is a bevel panel section formed by fold lines between said top panel and each of said side panels and a score line in each of said side panels.

7. A wrap-around beverage can carrier containing a product formation defined by adjacent rows and adjacent columns of cans, each of said cans having a top flange, comprising:

(a) a bottom panel having opposing side edges and opposing end edges;

(b) a first side panel and an opposing second side panel, each of said side panels having a top edge and an opposing bottom edge and further having opposing end edges, said bottom edge of each of said side panels being connected to one of said side edges of said bottom panel, said side panels having at least one cutout, said at least one cutout having opposing tabs, said at least one cutout being aligned between adjacent columns of articles;

(c) a top panel, said top panel including a first top panel and a second top panel, said first top panel having a side edge attached to said top edge of said first side panel, said second top panel having a side edge attached to said top edge of said second side panel, said first top panel being overlapped and attached to said second top panel, said first top panel and said second top panel further having opposing end edges;

(d) a pair of bottom end panels, each of said bottom end panels having a bottom edge, said bottom edge of each of said bottom end panels being connected to one of said end edges of said bottom panel;

(e) a pair of first top end panels and a pair of second top end panels, each of said first top end panels having a top edge connected to one of said end edges of said first top panel, each of said second top end panels having a top edge connected to one of said end edges of said second top panel;

(f) a pair of first side flaps and a pair of second side flaps, each of said first side flaps being connected to one of said end edges of said first side panel, each of said second side flaps being connected to one of said end edges of said second side panel; and (g) four first gussets and four second gussets, each of said first gussets including a web foldably connected to one of said first side flaps at a first fold line and to one of said end panels at a second fold line, each of said second gussets including a web foldably connected to one of said second side flaps at a first fold line and to one of said end panels at a second fold line, said first fold lines being oriented at approximately forty-five degrees with respect to a third fold line positioned at a junction between each of said side flaps and said side panels, said web being folded between said side web and said end panel.

8. A flat carrier blank for forming an article carrier, comprising:

(a) a bottom panel having opposing side edges and further having opposing end edges;

(b) a first side panel and an opposing second side panel, each of said side panels having a top edge and an opposing bottom edge and further having opposing end edges, said bottom edge of each of said side panels being connected to one of said side edges of said bottom panel, said side panels having at least one cutout, said at least one cutout having opposing tabs, said at least one cutout being aligned between adjacent columns of articles;

c) a top panel, said top panel including a first top panel and a second top panel, said first top panel having a side edge attached to said top edge of said first side panel, said second top panel having a side edge attached to said top edge of said second side panel, said first top panel being overlapped and attached to said second top panel, each of said first and second top panels further having opposing end edges;

(d) a pair of bottom end panels, each of said bottom end panels having a bottom edge, said bottom edge of each of said bottom end panels being connected to one of said end edges of said bottom panel;

(e) a pair of first top end panels and a pair of second top end panels, each of said first top end panels having a top edge connected to one of said end edges of said first top panel, each of said second top end panels having a top edge connected to one of said end edges of said second top panel; and (f) four first gussets and four second gussets foldably connected to each of said end panels, said first gussets being foldably connected to said first side panel, said second gussets being foldably connected to said second side panel.

9. The flat blank of claim 8, wherein said first side panel has a handle opening.

10. A flat carrier blank for forming a beverage can carrier, comprising:

(a) a bottom panel having opposing side edges and further having opposing end edges;

(b) a first side panel and an opposing second side panel, each of said side panels having a top edge and an opposing bottom edge and further having opposing end edges, said bottom edge of each of said side panels being connected to one of said side edges of said bottom panel, said side panels having at least one cutout, said at least one cutout having opposing tabs, said at least one cutout being aligned between adjacent columns of articles;

(c) a top panel, said top panel including a first top panel and a second top panel, said first top panel having a side edge attached to said top edge of said first side panel, said second top panel having a side edge attached to said top edge of said second side panel, said first top panel being overlapped and attached to said second top panel, said first top panel and said second top panel further having opposing end edges;

(d) a pair of bottom end panels, each of said bottom end panels having a bottom edge, said bottom edge of each of said bottom end panels being connected to one of said end edges of said bottom panel;

(e) a pair of first top end panels and a pair of second top end panels, each of said first top end panels having a top edge connected to one of said end edges of said first top panel, each of said second top end panels having a top edge connected to one of said end edges of said second top panel;

(f) a pair of first side flaps and a pair of second side flaps, each of said first side flaps being connected to one of said end edges of said first side panel, each of said second side flaps being connected to one of said end edges of said second side panel; and (g) four first gussets and four second gussets, each of said first gussets including a web foldably connected to one of said first side flaps at a first fold line and to one of said end panels at a second fold line, each of said second gussets including a web foldably connected to one of said second side flaps at a first fold line and to one of said end panels at a second fold line, said first fold lines being oriented at approximately forty-five degrees with respect to a third fold line positioned at a junction between each of said side flaps and said side panels, said web being folded between said side web and said end panel.

11. The flat carrier blank of claim 26 further including a handle opening in said first side panel.

* * * * *